US006921297B2

(12) United States Patent
Quadir et al.

(10) Patent No.: US 6,921,297 B2
(45) Date of Patent: Jul. 26, 2005

(54) HERMETIC TERMINAL ASSEMBLY AND ASSOCIATED METHOD OF MANUFACTURE

(75) Inventors: Tariq Quadir, West Chester, OH (US); Scott Schukmann, Maineville, OH (US); Craig Johnson, Mason, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/633,962

(22) Filed: Aug. 4, 2003

(65) Prior Publication Data

US 2004/0029443 A1 Feb. 12, 2004

Related U.S. Application Data

(63) Continuation-in-part of application No. 10/071,542, filed on Feb. 8, 2002, now Pat. No. 6,632,104.

(51) Int. Cl.[7] ..... H01R 24/00

(52) U.S. Cl. ..... 439/685; 439/587; 439/736; 439/733.1; 439/658; 439/693

(58) Field of Search ..... 439/685, 587, 439/736, 733.1, 727, 658, 693

(56) References Cited

U.S. PATENT DOCUMENTS

| | | | | |
|---|---|---|---|---|
| 3,160,460 | A | | 12/1964 | Wyzenbeck |
| 3,388,368 | A | | 6/1968 | Sauber |
| 3,605,076 | A | | 9/1971 | Dozier |
| 3,681,517 | A | | 8/1972 | Meyn |
| 3,721,948 | A | | 3/1973 | Brandt et al. |
| 3,770,878 | A | | 11/1973 | Dozier |
| 3,775,547 | A | | 11/1973 | Woods |
| 4,296,275 | A | | 10/1981 | Bowsky |
| 4,356,469 | A | | 10/1982 | Dozier |
| 4,480,151 | A | | 10/1984 | Dozier |
| 4,652,074 | A | | 3/1987 | Lombardi |
| 4,666,228 | A | | 5/1987 | Wood |
| 4,913,673 | A | * | 4/1990 | Kobler ..... 439/736 |
| 4,921,452 | A | | 5/1990 | Dozier |
| 4,984,973 | A | | 1/1991 | Itameri-Kinter |
| 5,029,969 | A | | 7/1991 | Seike et al. |
| 5,090,793 | A | | 2/1992 | Seike et al. |
| 5,344,337 | A | | 9/1994 | Ritter |
| 6,509,525 | B2 | | 1/2003 | Honkomp et al. |

OTHER PUBLICATIONS

PAVE Technology Website; http://www.pavetechnologyco.com/html/home.shtml; 2 pp.; © 1997–2002.

Douglas Engineering Website; http://www.douglaselectrical.com/html/explorer.html; 3 pp.; © 2002.

Two (2) Photographs of power bolt (2 pages) (data unknown).

International Search Report for corresponding PCT Patent Application No. PCT/US2004/023996 mailed Nov. 19, 2004.

* cited by examiner

*Primary Examiner*—Truc Nguyen
(74) *Attorney, Agent, or Firm*—Harness, Dickey & Pierce, PLC

(57) ABSTRACT

Several embodiments of a hermetic terminal assembly are disclosed and an associated method. The terminal assembly includes a metallic body that has body a bottom portion. The bottom portion includes an interior surface, an exterior surface and at least one opening. The terminal assembly also includes a current-conducting pin extending longitudinally through the opening, and a prefabricated dielectric retainer receiving the pin and covering at least a portion of the interior surface and surrounding at least a portion of the opening. The terminal assembly includes a dielectric epoxy bonding to the body, the retainer and the pin, and providing a seal between the pin and the opening in the bottom portion through which the pin is extending. In another embodiment, the prefabricated retainer may be omitted entirely.

24 Claims, 6 Drawing Sheets

HERMETIC TERMINAL ASSEMBLY AND ASSOCIATED METHOD OF MANUFACTURE

CROSS-REFERENCE TO RELATED APPLICATIONS

This application is a continuation-in-part of U.S. patent application Ser. No. 10/071,542 filed on Feb. 8, 2002 now U.S. Pat. No. 6,632,104, the disclosure of which is hereby incorporated in its entirety.

FIELD OF THE INVENTION

The present invention relates to electric terminals, and more particularly to terminals of the type which include one or more conductor pins which project through and are secured to a metallic body portion by a hermetic seal for disposing the ends of the conductor pins on opposite sides of the body portion.

BACKGROUND OF THE INVENTION

Hermetically sealed electric terminals provide an airtight electrical terminal for use in conjunction with hermetically sealed devices where leakage into or from such devices, by way of the terminals, is effectively precluded. For hermetically sealed electric terminals to function safely and effectively for its intended purpose, the terminals require that their conductor pins be electrically insulated from and hermetically sealed to the body portion through which they pass and that an optimum air path be established and thereafter maintained between adjacent portions of the pins and opposite sides of the body.

In a conventional hermetic terminal assembly, exemplified by U.S. Pat. No. 3,160,460 to Wyzenbeek, a straight, current carrying pin is fixed in place within a lip defining a hole in the terminal body by a fusible glass-to-metal seal. A resilient insulator is bonded to the face of the body beyond the extent of the glass-to-metal seal. The insulator includes outwardly projecting portions bonded to the conductor pins which define a predetermined air path between adjacent portions of the pins and the body member. Such a hermetic terminal construction has been the standard in the industry for four decades.

The primary object of the present invention is to provide a hermetic terminal assembly having conductor pins that are rigidly and hermetically secured to the body portion entirely by a resilient plastic which possesses the requisite materials properties, such as dielectric, moisture resistance, resistance to chemical breakdown, to provide for a hermetic seal. In addition to providing a hermetic seal between the conductor pins and the body, the same resilient plastic is bonded to the conductor pins to provide the desired air path between the pins and the face of the body portion.

Another object of the present invention is to provide such a terminal that is simple and economical to manufacture, such as by plastic injection molding.

SUMMARY OF THE INVENTION

The present invention provides a hermetic terminal assembly having a cup-shaped body portion with a generally flat bottom wall and at least one opening in the bottom wall defined by an annular lip. A current conducting terminal pin extends through each opening and beyond the lip on both ends of the body portion, the inner end of the terminal pin being on the dish side of the cup-shaped body portion, and the outer end of the terminal pin extending through and to the outer side of the body portion. A resilient plastic resin material is molded into place within the body portion and interlocks with the body portion and the terminal pins to fixedly secure the terminal pins in position relative to the body portion. The plastic resin material forms a hermetic seal between the terminal pin and the body portion. In addition, the plastic extends beyond the face of the body portion and covers the pin to provide the desired air path between the respective pins and each other and/or the face of the body portion.

In alternate embodiments of the present invention, the terminal pins include shank portions with varying surface configurations that are intended to enhance the bonding of the plastic resin to the terminal pin and improve the hermeticity of the seal. The terminal pins may also include fuse portions that are intended to open in response to predetermined current loads seen at the terminal pins.

In still another embodiment of the present invention, the terminal assembly includes a metallic body that has a bottom portion. The bottom portion includes an interior surface, an exterior surface and at least one opening having a wall. The terminal assembly also includes a current-conducting pin extending longitudinally through the opening, and a prefabricated dielectric retainer receiving the pin and covering at least a portion of the interior surface and surrounding at least a portion of the wall. The terminal assembly includes a dielectric epoxy bonding to the body, the retainer and the pin, and providing a seal between the pin and the opening in the bottom portion through which the pin is extending. Yet another variation of the invention is similar to the preceding embodiment but omits entirely the prefabricated retainer.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
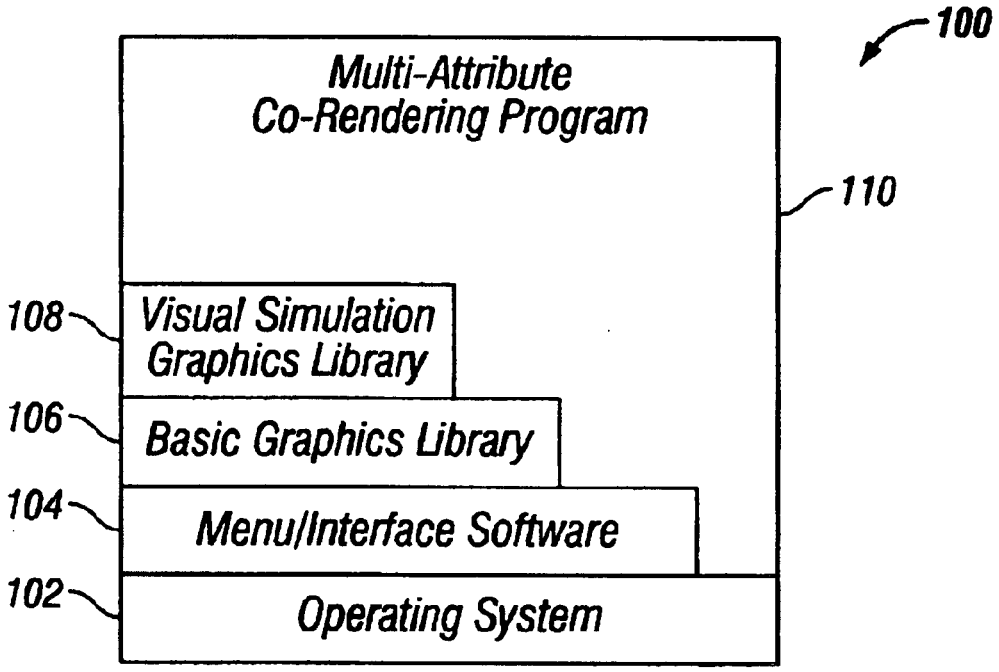
FIG. 1 is a perspective view of a hermetic terminal assembly.
Figure 2:
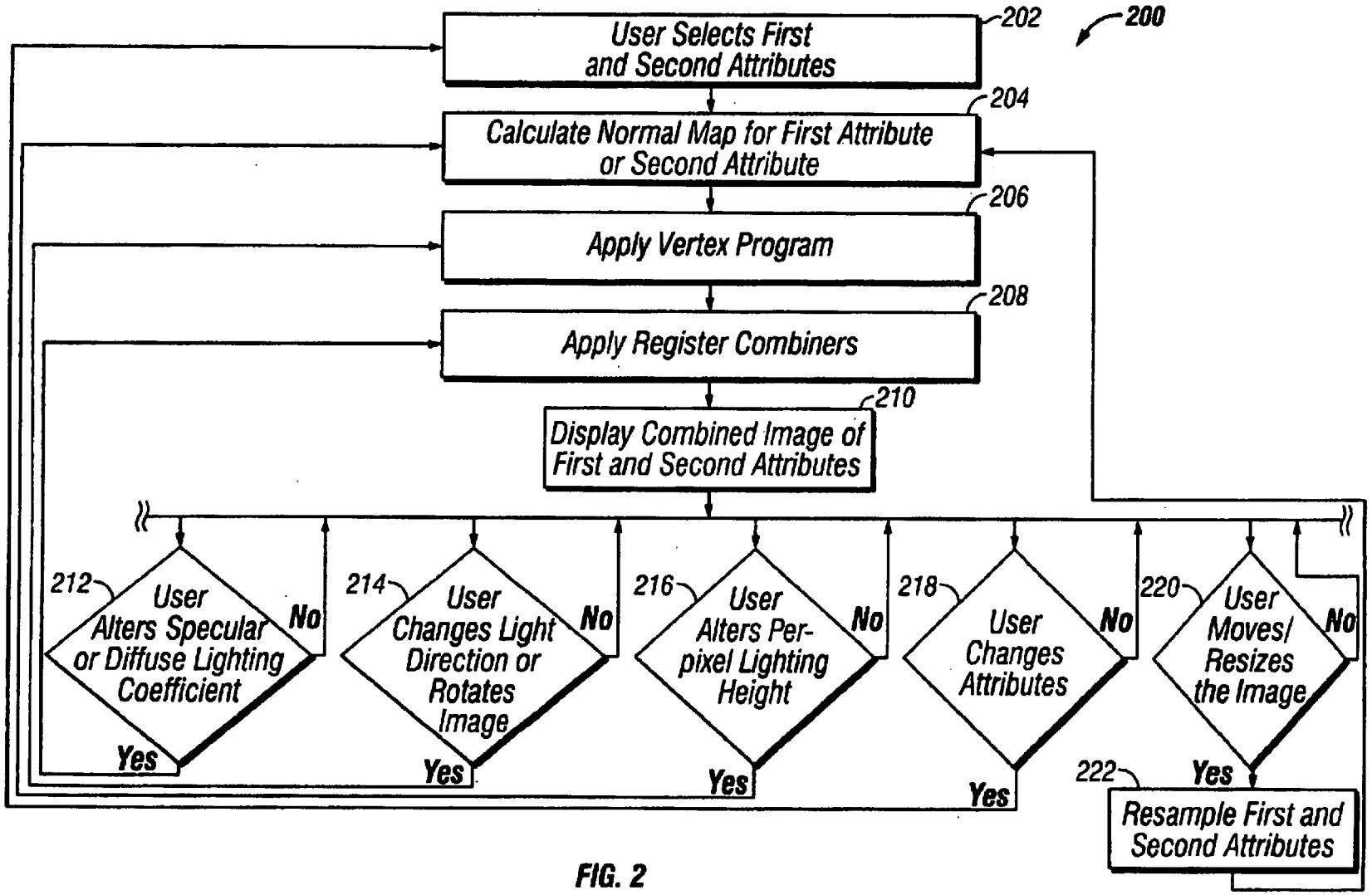
FIG. 2 is a cross-sectional side view of a first embodiment of the hermetic terminal assembly of the present invention.
Figure 3:
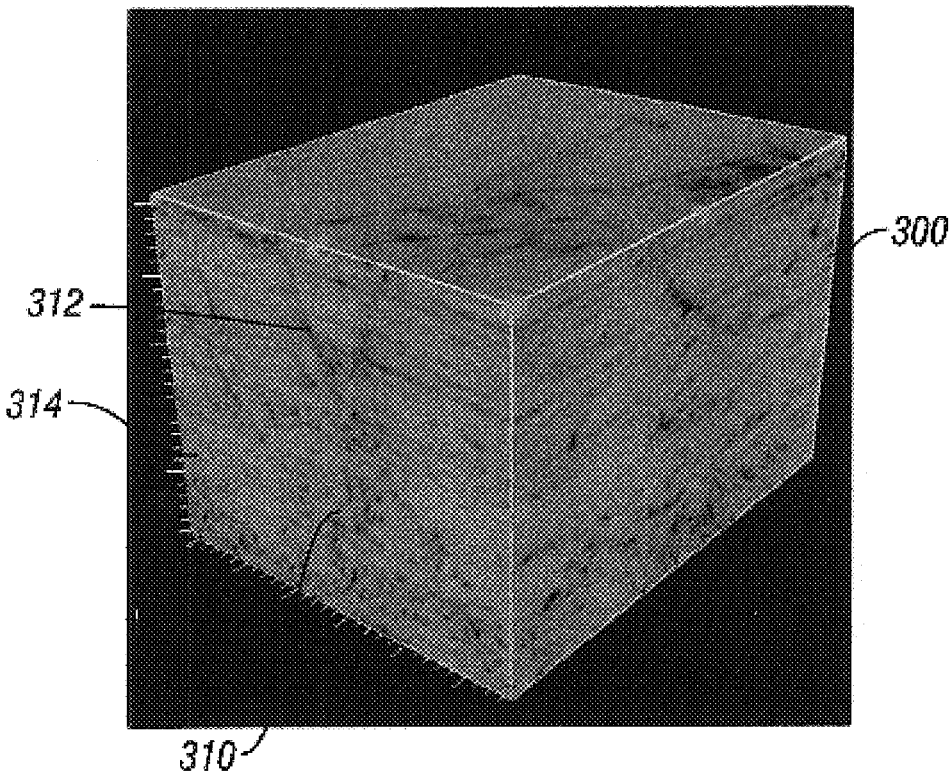
FIG. 3 is a cross-sectional perspective view of the hermetic terminal assembly of FIG. 2.

Referring now to the drawings FIGS. 1, 2 and 3, a hermetic terminal assembly 10 having a generally cup-shaped body portion 12 with a generally flat bottom 14 and side wall 16 with an outwardly flaring rim 18. The bottom 14 of the body portion 12 has a dish-side interior surface 22, an outside surface 24, and a plurality of openings 26. The openings 26 are each defined by an annular lip 28 with an inside wall surface 30, a free edge 32 on the dish side, and a radius 34 on the outside.

A current carrying terminal pin 36 with an outer end 38 and an inner end 40 may be fitted with a conventional terminal tab (not shown). The current carrying pin 36 is sealed within the opening 26 by a dielectric plastic resin material 44 that is molded directly into the body portion 12, which bonds to the body portion 12 and terminal pin 36. As molded, the plastic resin 44 creates a seal 46 that is an airtight hermetic seal between the terminal pin 36 and the body portion 12 such that leakage through the assembly 10, by way of the terminal pins 36, is prevented.

In a preferred embodiment, the plastic resin 44 is molded in and around the body portion 12 on each side of the bottom 14. The plastic resin 44 thereby covers both the dish-side surface 22 and the outside surface 24 of the bottom wall 20 and is mechanically interlocked with the body portion 12. The plastic resin provides an dielectric oversurface that covers the inside and outside of the terminal 10 body portion 12. Additionally, the plastic resin 44 may also include a sleeve portion 47 that bonds to and covers a portion of the terminal pin 36 projecting out of the body portion 12 to the outer end 38 of the to define the air path between the respective terminal pins 36 and/or the body portion 12, as desired.

On the dish-side, interior surface 22 of the body portion 12, the molded plastic resin 44 forms a plurality of neck portions 48 each of which is adjacent to, and surrounds, the annular lip 28 defining an opening 26 in the bottom wall 20 of the body portion 12. Each neck portion 48 extends along its respective terminal pin 36 toward the inner end 40 for about a quarter to a third of the distance that the terminal pin 36 protrudes from the dish-side surface 22 of the terminal 10 body portion 12. In addition to providing a dielectric oversurface, the neck portions 48 increase the length of the hermetic seal 46 and better fixes the terminal pins 36 in place.

Each terminal pin 36 has a shank portion 50 which passes through the terminal 10 body portion 12. The plastic resin 44 fills the space between the inside wall 30 and the shank portion 50 of the terminal pin 36 to create the hermetic seal 46 and to bond the terminal pin 36 to the terminal 10 body portion 12. Included in the shank portion 50 of the terminal pin 36 is a fuse section 52 which is encompassed by the seal 46 so as to be internal to the terminal 10 body portion 12. The fuse section 52 has a necked down diameter from the remainder of the terminal pin 36. The fuse section 52 is intended to open at currents in excess of a predetermined current-carrying capacity. Alternatively, the terminal pin 36 may be configured with a fuse that is external to the terminal 10 body portion 12, such as a terminal pin that is disclosed in U.S. Pat. No. 5,017,740 to Honkomp et al., which is hereby incorporated into this disclosure by reference.

The plastic resin 44, molded to create the hermetic seal 46, must possess the appropriate electrical and mechanical properties that are required for the application and operating environment in which the hermetic terminal assembly will be utilized. Typical minimum engineering material requirements may include:

| Physical Property | Requirement |
|---|---|
| Hydrostatic Pressure | 2250 psi |
| Hermeticity | $1 \times 10^{-7}$ atm cc/sec He |
| Dielectric Voltage | Minimum 2500 V with < 0.5 mA leakage |
| Insulation Resistance | >10,000 MΩ at 500 Vdc |
| Operating Temperature | 150° F. to 300° F. |
| Operating Environment | Mineral oil or refrigerant |

A plastic resin that is suitable for use with the present invention is a moldable plastic resin which can provide the dielectric oversurface and hermetic seal 46 as disclosed. One such moldable plastic resin is polyphenyl sulfide (PPS), which is know under the tradename Ryton®. In addition, other moldable plastic resins that possess the necessary electrical and mechanical properties may also be used, including liquid crystalline polymer compositions (LCPs). An example of one such material is available commercially from DuPont under the tradename Zenite®.

Further, there may be applications for the terminal assembly 10 of the present invention having less demanding operational or performance requirements, where a fully hermetic seal may not be not necessary, and a less-than-airtight, semi-hermetic seal or even non-hermetic seal is all that is required. It is fully contemplated that a terminal assembly 10 of the present invention may be applicable for use in such applications. Additional moldable plastic resins that may be suitable for use with this invention in such applications are polypropylenes, thermoplastic polyolefins, and polyvinylchlorides like Bakelite®.

The terminal pin 36 is manufactured from an electrically conductive material, such as solid copper or steel. Alternatively, a bimetallic, copper core wire, having high electrical conductivity and possessing good hermetic bond characteristics with the plastic resin 44 may also be utilized.

Figure 4:
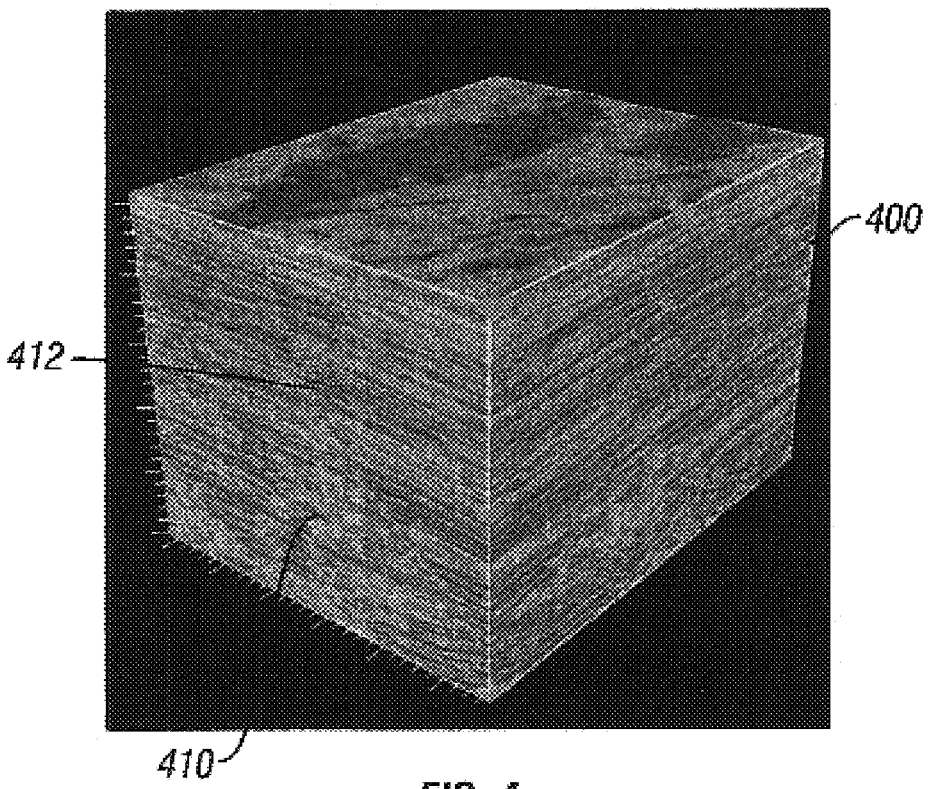
FIG. 4 is a cross-sectional side view of a second embodiment of the hermetic terminal assembly of the present invention.
Figure 5:
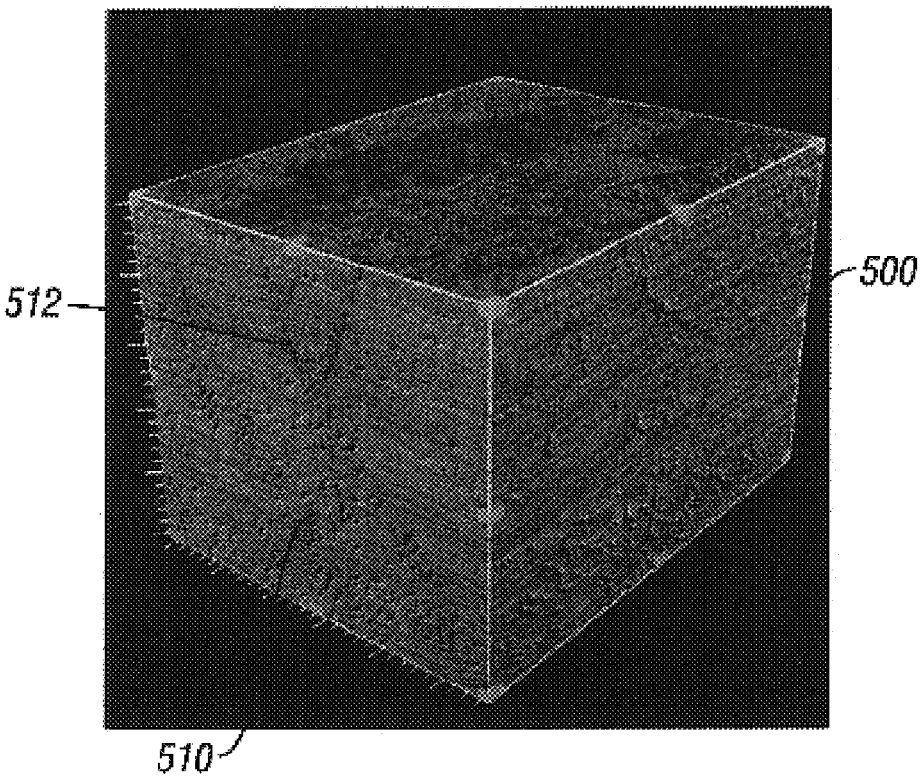
FIG. 5 is a cross-sectional perspective view of the hermetic terminal assembly of FIG. 4.

Referring now to FIGS. 3 and 4, a second embodiment of the hermetic terminal assembly 10' of the present invention is illustrated. Elements and features common to both the first and second embodiments shown in the Figures are identified with like reference numerals.

Included in the shank portion 50' of the terminal pin 36' is a section 54 having a scuffed surface 56 of increased surface roughness. Such a surface may be achieved by mechanical means, such as sanding or grit blasting the terminal pin 36' or by other similar processes, or by chemical means. The scuffed surface 56 is included in terminal pin 36' to create an increased surface area over which the plastic resin 44' may contact and mechanically engage the terminal pin 36' to increase the strength of the bond with the plastic resin 44' and improve the hermeticity of the seal 46'. Although not shown in FIGS. 3 and 4, the terminal pin 36' may also incorporate a fuse section, similar to that disclosed above. Such a fuse section could also include a scuffed surface 56.

Additionally, as described above, the plastic resin 44' may also cover a portion of the projecting outer end 38' of the terminal pin 36' to define the air path between the respective terminal pins 36' and/or the body portion 12', as desired.

Figure 6:
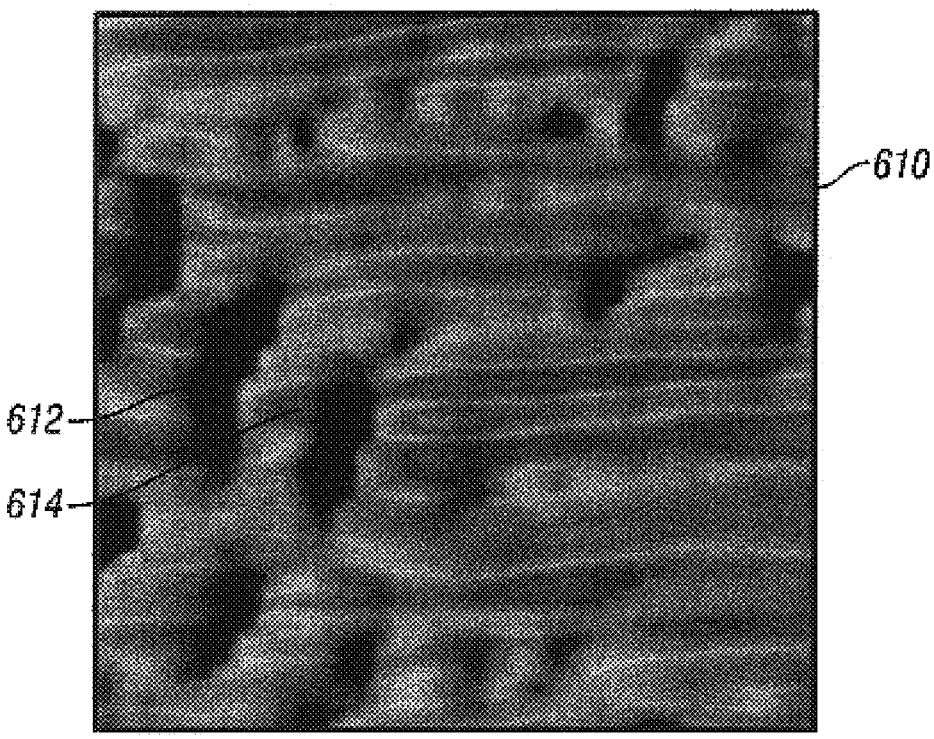
FIG. 6 is a cross-sectional side view of a third embodiment of the hermetic terminal assembly of the present invention.
Figure 7:
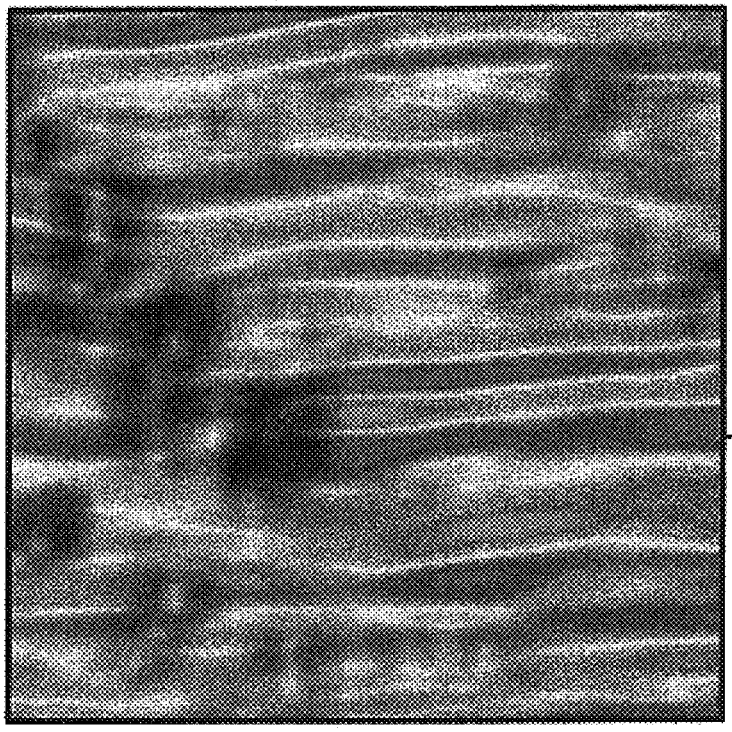
FIG. 7 is a cross-sectional perspective view of the hermetic terminal assembly of FIG. 6.

Yet another embodiment of the hermetic terminal assembly 10" of the present invention is shown in FIGS. 6 and 7. In this third embodiment, the terminal 10" has a generally cup-shaped body portion 12" with a side wall 16" having an outwardly flaring rim 18". The body portion does not have a generally continuous, closed bottom, but instead has only an inwardly extending peripheral lip 58 which extends from the side wall 16" at the end opposite the rim 18". The plastic resin 44" is molded in and around the peripheral lip 58 and is thereby mechanically interlocked with the body portion 12". As with those embodiments described above, the plastic resin 44" may also be molded over a portion of the projecting outer end 38" of the terminal pin 36" to define the air path between the respective terminal pins 36' and/or the body portion 12", as desired.

The terminal pin 36" of the third embodiment of the present invention may also differ from the terminal pins 36 and 36' disclosed above. As shown in FIG. 6, the shank portion 50" of the terminal pin 36" is a section 54' forming a threaded surface 56'. Similar to that described above, the threaded surface 56' is included in terminal pin 36" to increase the surface area of the terminal pin 36" over which the plastic resin 44" may contact and mechanically engage the terminal pin 36". The increased area of engagement correspondingly increases the strength of the bond between the terminal pin 36" and the plastic resin 44" and improves the hermeticity of the seal 46". Again, the terminal pin 36" may also incorporate a fuse section, similar to that disclosed with respect to FIGS. 1 and 2 above. Such a fuse section could also include a threaded surface 56'.

Figure 8:
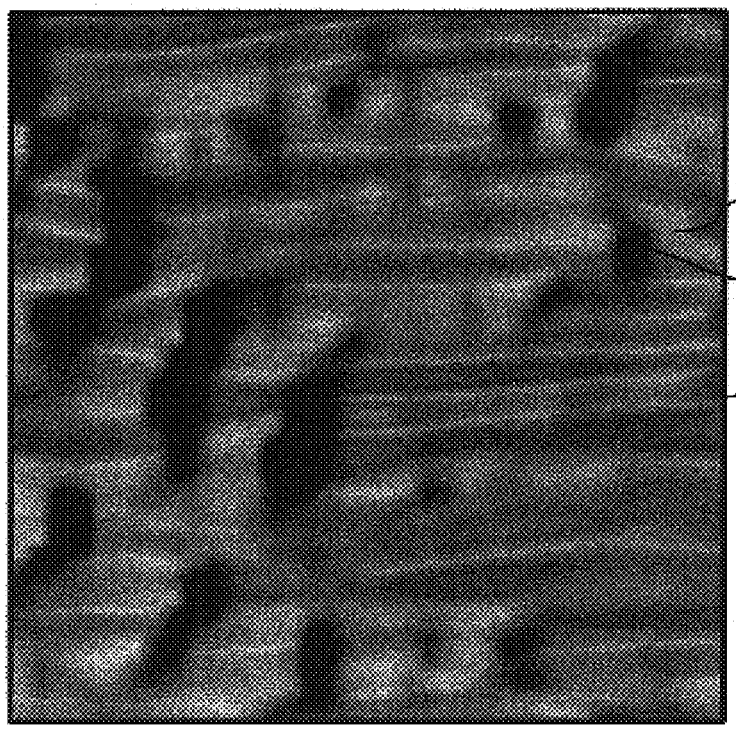
FIG. 8 is an exploded view of a fourth embodiment of the hermetic terminal assembly of the present invention, shown before manufacture.
Figure 9:
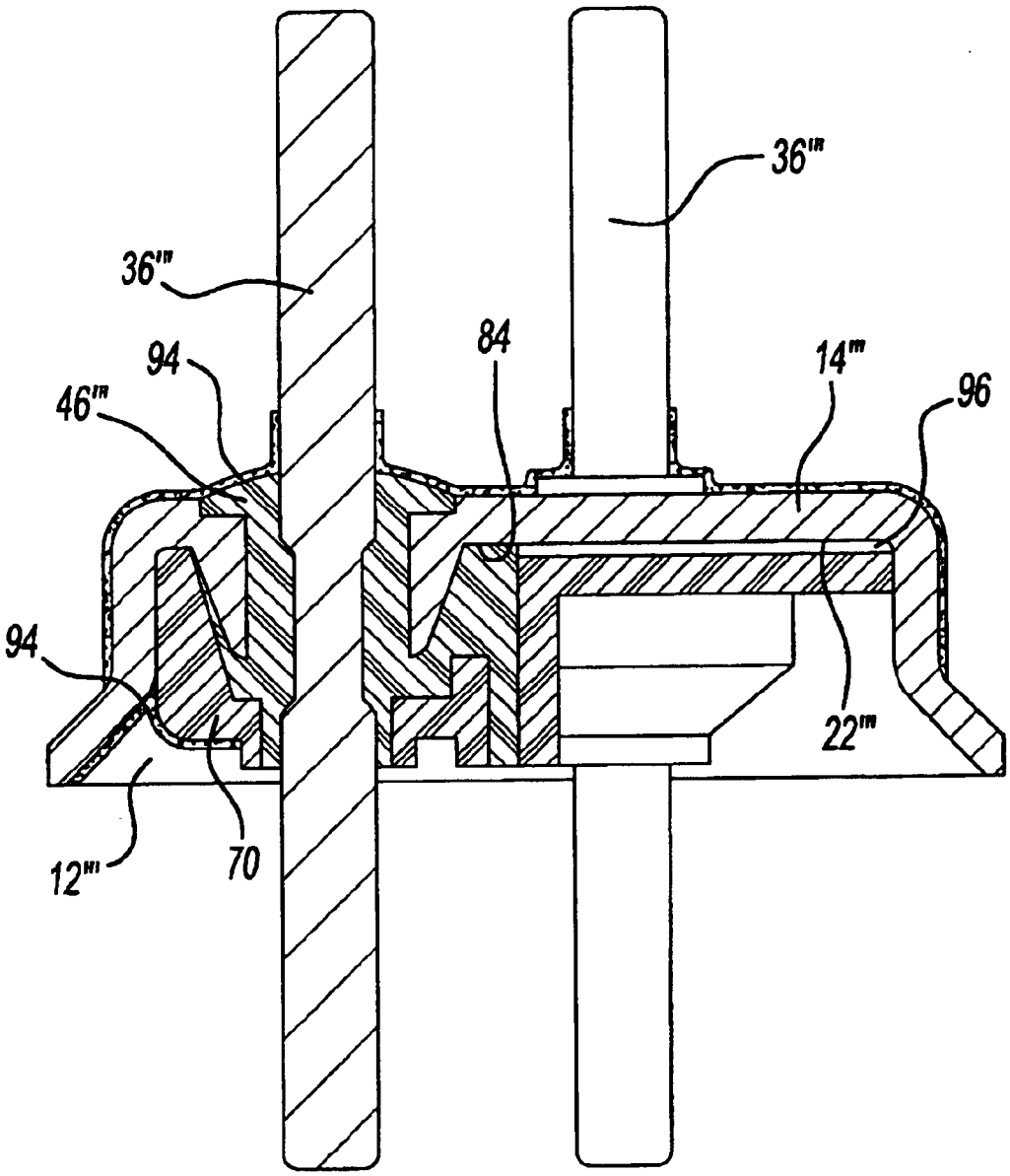
FIG. 9 is a cross-sectional side view of the fourth embodiment of the hermetic terminal assembly.

A fourth embodiment of the terminal assembly 10'" is depicted in FIGS. 8 and 9. Elements and features common to both the first and fourth embodiments shown in the Figures are identified with like reference numerals, and their detailed description will not be repeated. The fourth embodiment 10'" includes a body portion 12'" having a bottom portion 14'", an opening 26'" bounded by a wall 30'", and a pin 36'". The terminal assembly 10'" includes a prefabricated retainer 70. The retainer 70 may be pre-molded from dielectric plastic resin, such as Ryton® or Zenite, for example, and it may also made from other dielectric materials, including ceramics, such as, silicon nitride ($Si_3N_4$), aluminum nitride (AIN), or zirconium oxide ($ZrO_2$).

The retainer 70 includes at least one pin hole 72 and a countersunk portion 74 around the pin hole 72. When the terminal assembly 10'" includes more than one pin 36'", the retainer 70 includes a corresponding number of pin holes 72. The retainer 70 may also include a cavity 76 that communicates with the countersunk portion 74 of the pin hole 72.

Referring to the exploded view of the terminal assembly 10'" during the manufacturing process and illustrated in FIG. 8, the terminal assembly 10'" also includes a first epoxy ring 78 that is received in the countersunk portion 74 of the pin hole 72. The epoxy ring 78 comprises a thermoset epoxy powder, which, when heated, cross links to cure and harden forming a strong bond with any surface with which it is in contact. The epoxy may be an electrically insulating epoxy, such as one the Corvel® epoxies, available from Rohm and Haas Powder Coatings, Flying Hills, Pa., or any other epoxy possessing similar characteristics. When cured, the epoxy provides a hard coverage material with electrical insulation properties, resistance to chemicals and low moisture permeability.

The body portion 12'" is placed over the retainer 70 and the first epoxy ring 78 such that the walls 30'" of the openings 26'" of the body portion 12'" are received in and surrounded by the corresponding countersunk portions 74 of the pin holes 72. The countersunk portions 74 are, accordingly, sleeve-like and appropriately sized and shaped to receive the walls 30'". A second epoxy ring 80 is placed over the openings 26'" on the exterior surface 24'" of the bottom 14'" of the body portion 12'". The second epoxy ring 80 may be received in a corresponding countersunk portion 82 of the body portion 12'".

The terminal assembly 10'" is processed in an oven or other heating chamber to cure the epoxy. For a Corvel® 17000 Series epoxy, for example, curing may take place at a heating temperature of 180° C. for 40 minutes. It will be appreciated that the curing temperature and duration may vary depending on the characteristics of the particular epoxy that is used. During heating, the epoxy rings 78 and 80 flow into and fill the space created between the walls 30'" of the body portion 12'", the pin 36'", the pin hole 72 and the countersunk portion 74 of the pin hole 72. Moreover, overflow epoxy is received in the cavity 76. Thus, upon curing, the hardened epoxy of the rings 78 and 80 provides a hermetic seal 46'" surrounding each pin 36'". For applications in which full hermeticity is not required, other epoxies providing lesser hermeticity may also be used.

It will be appreciated that the thickness and size of the epoxy rings 78, 80 may be adjusted to provide a sufficient volume of epoxy such that the cured epoxy completely fills the void and forms an airtight seal 46'" between the terminal pin 36'" and the body portion 12'" and such that leakage through the assembly 10'", by way of the terminal pins 36'", is prevented. As shown in FIG. 9, the seal 46'" that is formed from the cured epoxy completely surrounds the portion of the terminal pin 36'" that is bounded by the body portion 12'" and the retainer 70. In the embodiments in which an overflow cavity 76 is included, the cavity 76 is also sealed with the cured epoxy creating another surface 84 that bonds the retainer 70 with the interior surface 22'" of the bottom 14'" of the body portion 12'" and forms a mechanical and insulating interlock.

Is should be noted the amount of the epoxy that is available from the epoxy rings 78 and 80 is determined to completely fill the space between the pins 36''' and the body portion 12''' and also provide a mechanical interlock after the epoxy is cured. This amount is determined by taking into account that the thermal expansion characteristics of the epoxy and the metal of the body portion 12''' are very different. The Corvell® 17000 Series epoxy, for example, has a coefficient of thermal expansion of $340\times10^{-7}$ in./in./° C., which may be 2.5 or more higher than the coefficient of thermal expansion of the metallic components (the body portion 12''' and pins 36'''), which is typically about $135\times10^{-7}$ in./in./° C. Therefore, after curing, the epoxy that forms the seal 46''' will shrink to a much greater extent that the surrounding metallic components. A sufficient amount of epoxy is provided to take into account the shrinkage effect, so that the seal 46''' completely fills the space between the body portion 12''' and the pins 36''' and forms a mechanical interlock, as shown in FIG. 9.

The properties of the seal 46''' have been tested experimentally. A summary of representative tests conditions and corresponding results follows:

| Physical Property | Typical Measurement |
|---|---|
| Pressure Test | 5600 +/− 500 psi |
| Hermeticity | $1\times10^{-7}$ atm cc/sec He |
| Maximum Voltage | 4700 V |
| Insulation Resistance | >10,000 MΩ |
| Heat Shock | 371° C. |
| Thermal cycling | 120° C. to −25° C. for one week |
| Cryogenic test | −65° C. five cycles |

Referring to FIG. 8, the terminal assembly 10''' may be manufactured using an assembly board 90 that includes a plurality of pin fixtures 92 for supporting the terminal pins 36''' during assembly. First, the terminal pins 36''' are inserted into the fixtures 92 of the assembly board 90. Then, the retainer 70 is placed over the terminal pins 36'''. The first epoxy rings 78 are placed in the countersunk portions 74 of the retainer 70 over the terminal pins 36'''. Then, the body portion 12''' is placed over retainer 70 such that the walls 30''' of the openings 26''' of the body portion 12''' are received into the countersunk portions 74 of the retainer 70. Finally, the second epoxy ring 80 is placed over the body portion 12''' and into a countersunk portion 82 of the body portion 12'''. The assembly board 90 with the terminal assemblies 10''' thereon may then be transported to an oven for curing.

As discussed above, the retainer 70 can be prefabricated from a variety of dielectric materials, including ceramic, plastic resins, or Ryton®), which also have the advantage not to stick on the pin fixtures 92, which may be made of ceramic or metallic material. Thus, the terminal assembly 10''' may be easily removed from the pin fixtures 92 after curing. It will be, therefore, appreciated that prefabrication of the retainer 70 contributes to ease of assembly and manufacturability. Furthermore, the retainer 70 adds strength to the terminal assembly 10''' and provides a dielectric oversurface on the pins and body. Similarly, the use of the epoxy rings 78, 80 further simplifies the assembly and manufacturing process, while providing a seal 46''' that has impressive hermeticity properties.

Referring again to FIG. 9, at least a portion of the outer surface of the terminal assembly 10''' may be coated with a thin layer 94 of plastic resin or other electrically insulating resin to provide additional electrical and chemical resistance. Additionally, an adhesive 96 may be applied to the inner surface 22''' of the bottom 14''' and/or other surfaces of the body portion 12''' to enhance the bond between the retainer 70 and the body portion 12'''. The adhesive 96 may brushed or sprayed, and it may also be applied to the retainer 70 and the pins 36''' at all their common contact surfaces. The Scotch-Grip™ rubber and Gasket Adhesive manufactured by 3M of St. Paul, Minn., may be used to prepare the adhesive 96, for example. The adhesive 96 may also be used with the in situ plastic resin 44, 44', 44" of the first, second and third terminal assembly embodiments 10,10', 10".

In a variation of the fourth embodiment 10''', the retainer 70 may be omitted, while either retaining or omitting the plastic resin layer 94 to cover the body portion 12''', after the epoxy rings 78, 80 are cured sealing the opening 26''' between the body portion 12''' and the pin 26''', depending on the particular application.

Of course, any of the features of the body portions 12, 12', 12", 12''' or terminal pins 36, 36', 36", 36''' may be combined in various ways to create a hermetic terminal assembly within the contemplation of the present invention.

While the invention has been disclosed and described in it various embodiments, it is understood that the invention is capable of modification without departing from the spirit and scope of the invention as set forth in the appended claims.

What is claimed is:

1. A hermetic terminal assembly comprising:

a body having a bottom portion, the bottom portion comprising an interior surface, an exterior surface and at least one opening having a wall;

a prefabricated dielectric retainer located adjacent to the interior surface of the bottom portion of the body and surrounding at least a portion of the wall, the retainer including at least one aperture therethrough;

a current-conducting pin extending longitudinally through the opening in the body and the aperture of the retainer; and a dielectric epoxy bonding to the body, the retainer and the pin, and providing a seal between the pin and the opening in the bottom portion through which the pin is extending.

2. The terminal assembly of claim 1, wherein the exterior surface of the bottom portion includes a countersunk portion sealed with the epoxy.

3. The terminal assembly of claim 1, wherein the retainer includes an annular countersunk portion adjacent to the aperture that is sealed with the epoxy.

4. The terminal assembly of claim 1, further including an adhesive on the interior surface of the body.

5. The terminal assembly of claim 1, further including an adhesive on the exterior surface of the body.

6. The terminal assembly of claim 1, wherein the retainer is formed from a plastic resin.

7. The terminal assembly of claim 1, wherein the retainer is formed from a ceramic.

8. The terminal assembly of claim 3, wherein the retainer includes a cavity communicating with the countersunk portion and sealed with the epoxy.

9. The terminal assembly of claim 3, wherein the countersunk portion receives at least a portion of the wall of the body.

10. A hermetic terminal comprising:

a body comprising an interior surface, an exterior surface, at least one opening, and an annular recess located in the exterior surface adjacent to the opening;

a current conducting pin extending longitudinally through the opening; and a dielectric plastic covering at least portions of each of the interior surface, the opening and the annular recess of the body, the plastic bonding to both the body and the pin and providing a hermetic seal between the pin and the opening.

11. The terminal assembly of claim 10, wherein the plastic is selected from the group consisting of polyphenyl sulfide, liquid crystalline polymers, polypropylenes, thermoplastic polyolefins, and polyvinylchlorides.

12. The terminal assembly of claim 10, wherein the plastic is epoxy.

13. The terminal of claim 10 wherein the hermetic seal is of at least about $1\times10^{-6}$ atm cc/sec He.

14. The terminal assembly of claim 10, wherein the plastic is molded in situ.

15. The terminal assembly of claim 10, wherein an adhesive is interposed between the plastic and the body.

16. The terminal assembly of claim 15, wherein an adhesive is interposed between the plastic and the pin.

17. The terminal assembly of claim 16, wherein the adhesive is an electrically insulating epoxy.

18. A hermetic terminal comprising:

a body comprising at least one opening therethrough and an annular recessed portion located adjacent to the opening in an exterior surface of the body;

a current-conducting pin extending through the opening; and a dielectric epoxy disposed in the opening and in the annular recessed portion, the epoxy bonding to the body and the pin and providing a hermetic seal between the body and the pin.

19. The terminal of claim 18 wherein the hermetic seal is of at least about $1\times10^{-6}$ atm cc/sec He.

20. The terminal assembly of claim 18, further comprising a dielectric retainer placed over the pin and adjacent to an interior surface of the body.

21. The terminal assembly of claim 20, wherein the retainer includes an annular countersunk portion sealed with the epoxy.

22. The terminal assembly of claim 21, wherein the retainer includes a cavity communicating with the countersunk portion and sealed with the epoxy.

23. The terminal assembly of claim 20, further comprising an adhesive covering at least a portion of an exterior surface of the body.

24. The terminal assembly of claim 20, further comprising an adhesive covering at least a portion of the interior surface of the body.

* * * * *